United States Patent [19]

Patton et al.

[11] Patent Number: 4,854,852

[45] Date of Patent: Aug. 8, 1989

[54] SYSTEM FOR REDUNDANTLY PROCESSING A FLAME AMPLIFIER OUTPUT SIGNAL

[75] Inventors: Paul B. Patton, Rockford; William R. Landis, Bloomington, both of Minn.

[73] Assignee: Honeywell Inc., Minneapolis, Minn.

[21] Appl. No.: 99,379

[22] Filed: Sep. 21, 1987

[51] Int. Cl.[4] ..... F23N 5/00

[52] U.S. Cl. ..... 431/78

[58] Field of Search ..... 431/78, 24, 66, 77

[56] References Cited

U.S. PATENT DOCUMENTS

| | | | |
|---|---|---|---|
| 2,775,291 | 12/1956 | Wilson | 158/28 |
| 3,463,600 | 8/1969 | Axmark | 431/16 |
| 3,832,123 | 8/1974 | Walbridge | 431/78 |
| 3,854,056 | 12/1974 | Cade | 307/117 |
| 4,000,961 | 1/1977 | Mandock | 431/2 |
| 4,235,587 | 11/1980 | Miles | 431/73 |
| 4,278,419 | 7/1981 | Bechtel et al. | 431/24 |
| 4,298,334 | 11/1981 | Clark et al. | 431/24 |
| 4,375,951 | 3/1983 | Bohan, Jr. | 431/46 |
| 4,399,537 | 8/1983 | Jones | 371/14 |
| 4,461,615 | 7/1984 | Inoue | 431/76 |
| 4,639,717 | 1/1987 | De Meirsman | 340/578 |

*Primary Examiner*—Larry Jones

*Attorney, Agent, or Firm*—Edward Schwarz

[57] ABSTRACT

A flame safeguard control system using a microcomputer is disclosed. The microcomputer responds to the flame signal as provided from a normal flame amplification chain and an analog-to-digital converter. A safety backup circuit in the form of a redundant flame signal detection circuit analyzes the analog signal being provided to the analog-to-digital converter. In the event that the microcomputer is unable to shut the main fuel valve off, the redundant flame detection circuit becomes operative to deenergize part of a series circuit including the relay for the main fuel valve.

14 Claims, 1 Drawing Sheet

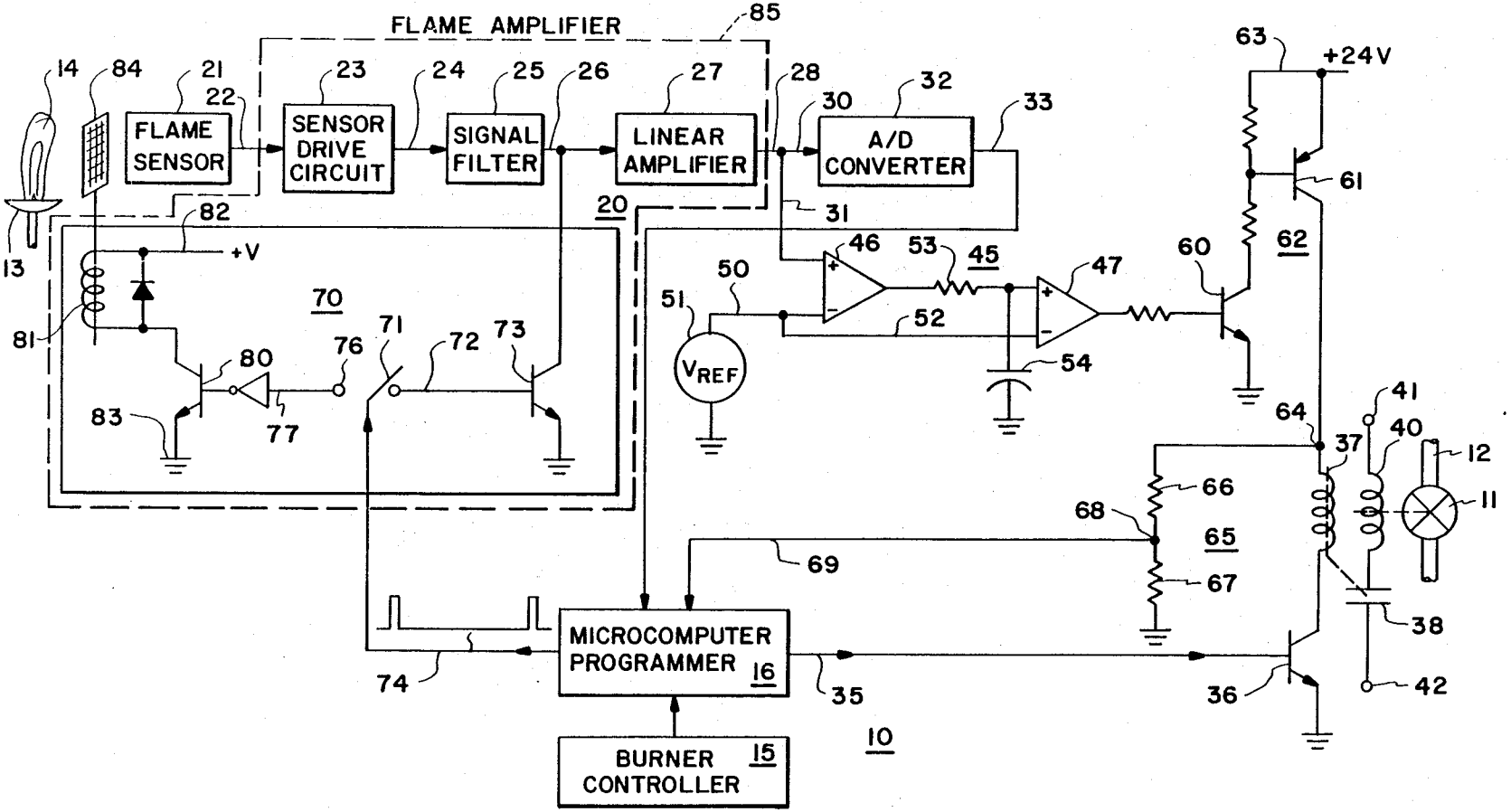
FLAME AMPLIFIER
FLAME SENSOR
SENSOR DRIVE CIRCUIT
SIGNAL FILTER
LINEAR AMPLIFIER
A/D CONVERTER
MICROCOMPUTER PROGRAMMER
BURNER CONTROLLER
+24V
+V
$V_{REF}$

SYSTEM FOR REDUNDANTLY PROCESSING A FLAME AMPLIFIER OUTPUT SIGNAL

BACKGROUND OF THE INVENTION

Flame safeguard systems that utilize a flame sensor and amplifiers for control of valve means in a burner system have been utilized for many years. Typically these systems use discrete component electronic systems in their amplifiers, and the amplifiers in turn ultimately control a relay. The relay in turn is used to switch power for an electromagnetically operated fuel valve. As the electronic and electromechanical types of flame safeguard systems evolved, the reliability and safety of the systems has been of prime concern. As a result of this concern, systems and equipment have been developed which are very reliable and allow the flame safeguard system to accurately and reliably control the operation of the main fuel valve to a burner in response to the presence or absence of flame at the burner.

In recent years microcomputer based systems have evolved. These systems utilize very small and complex integrated circuits. The microcomputers, while having many capabilities, have a frailty in that they are subject to many more types of failures than discrete component electronic circuits. The utilization of a microcomputer in a flame safeguard control system requires a high degree of care, and the use of special safety systems. In a prior art type of microcomputer based flame safeguard system as disclosed in U.S. Pat. No. 4,298,334, assigned to the assignee of the present invention, the microcomputer and flame amplifier both controlled power to the main fuel valve relay. This type of redundant circuitry is expensive, and may be improved upon by the present invention.

SUMMARY OF THE INVENTION

In the invention of the present flame safeguard control system, the flame amplifier is no longer able to control power to the main fuel valve relays; it merely converts the flame sensor's output signal into a proportional direct current analog signal that is processed by the flame safeguard control system. Since the flame amplifier's direct control over the main fuel valve relay is gone; additional circuitry was added to the flame safeguard control system to protect against improper main fuel relay operation if the microcomputer fails. The main fuel valve relay is controlled in a series circuit by two individual transistors. The first of the transistors is controlled by a redundant flame signal detection circuit that responds solely to the output signal from the flame amplifier network. The redundant flame signal detection circuit operates completely independently of the microcomputer and thereby provides a backup means of turning off or controlling the main fuel valve relay.

In the present invention a microcomputer controlled system provides the primary control of the main fuel valve relay by means of a second transistor in series with the main fuel valve relay coil and the transistor from the redundant flame signal detection circuit. In the event of a failure in the microcomputer, the redundant flame signal detection circuit insures that the main fuel valve can be properly deenergized.

In accordance with the present invention, there is provided a control system for processing a flame responsive output signal to insure cut-off control of main fuel valve means, including: a microcomputer flame safeguard control system adapted to operate a fuel burner including main fuel valve means; said flame safeguard control system including a flame sensor adapted to respond to flame at said fuel burner; flame amplifier means having input means connected to said flame sensor and output means providing an analog signal representative of flame at said fuel burner; analog-to-digital converter means having input means connected to receive said analog signal from said flame amplifier means, and having output means connecting a digital signal to said microcomputer to provide said microcomputer with a digital signal representative of flame at said fuel burner; said microcomputer having output means connected to said fuel valve means to control the energization of said fuel valve means; redundant flame signal detection circuit means having input means connected to said analog signal representative of flame at said fuel burner; said redundant flame signal input means further including a reference voltage; said redundant flame signal detection circuit means including amplifier means comparing said reference voltage and said analog signal; said redundant flame signal detection circuit means having switched output means connected in a series circuit with said microcomputer output means to redundantly control the energization of said fuel valve means; and voltage divider network means having an input connected to said series circuit and an output connected to said microcomputer to supply said microcomputer with a signal representative of the state of operation of said redundant flame signal detection circuit means; said fuel valve means being capable of being deenergized by the operation of said microcomputer output means, or the operation of said redundant flame signal detection circuit means.

BRIEF DESCRIPTION OF THE DRAWING

The single FIGURE is a schematic representation of a section of a flame safeguard control system for processing the flame responsive output signal.

DESCRIPTION OF THE PREFERRED EMBODIMENT

The single FIGURE of the present disclosure is directed to a control system generally disclosed at 10, and typically is referred to as a flame safeguard control system. The control system is used to control a main fuel valve 11 that is connected to a pipe 12 for supply of main fuel to a fuel burner 13 which has a flame 14. The valve 11, the piping 12, the burner 13 and the flame 14 are representative of a small portion of a fuel burner and system, and it is understood that the balance of the fuel burner is conventional in design and is operated generally by the control system 10. The balance of the fuel burner has not been shown as it is not essential to the present invention and would merely add confusion to the disclosure of the present invention.

The control system 10 operates under the control of burner controller 15 which can be any type of pressure or temperature transducer. The burner controller 15 supplies a signal to a microcomputer based flame safeguard programmer or control 16. The programmer 16 typically would supply the necessary control signals and timing for prepurge, pilot burner ignition, main burner ignition, and other associated equipment. A system of the type compatible with this invention is currently marketed and identified as the BC7000 "Blue Chip" Microcomputer Burner Control System as sold by Honeywell Inc., the assignee of the present invention. Only the necessary components of the present invention will be disclosed and discussed in detail.

A flame detection system 20 is disclosed as part of the flame safeguard control system 10. A flame sensor 21 responds to flame 14 and provides a signal on conductor 22 to sensor drive circuit 23. The sensor drive circuit has an output by way of conductor 24 to a signal filter 25 that can indicate a flame loss within 0.25 second after it occurs. The output of the signal filter 25 is by way of conductor 26. The flame signal at conductor 26 is inputted to a linear amplifier 27 that has an output 28 that is an analog signal of approximately zero to five volts. This signal is divided by conductors 30 and 31. The conductor 31 supplies the analog signal to an analog-to-digital converter 32 that then has an output at 33 in a digital form corresponding to the magnitude of the analog signal which is a direct function of the flame sensed at 21. The digital output 33 is supplied to the microcomputer flame safeguard programmer 16 so that the microcomputer programmer 16 can control the balance of the system including the main fuel valve 11.

The microcomputer flame safeguard programmer 16 has an output on conductor 35 to control a transistor 36. The transistor 36 is connected in series with a main fuel valve relay 37 that has a normally open pair of contacts 38. the contacts 38 connect a coil 40 of the main fuel valve 11 to a source of power 41 and 42. It is obvious that when the relay coil 37 is energized and the contacts 38 close, that the main fuel valve 11 is opened and fuel is supplied to the main burner which forms part of the burner means 13.

The analog output voltage on conductor 28 is supplied on the conductor 31 to a redundant flame signal detection circuit means generally disclosed at 45. The redundant flame signal detection circuit means 45 includes a pair of operational amplifiers 46 and 47 with the input conduct 31 connected to the non-inverting terminal of the operational amplifier 46. The inverting terminal of the amplifier 46 is connected by a conductor 50 to a voltage reference source 51. The voltage reference source 51 is also connected by conductor 52 to an inverting terminal of the amplifier 47. The first amplifier 46 is connected to the second amplifier 47 by a resistor 53 and a capacitor 54 that forms a timing circuit, the purpose of which will be explained in connection with the overall operation of the device.

The amplifier 47 is connected to a pair of transistors 60 and 61 that forms a switch means 62 to supply power from a voltage source conductor 63 to a junction 64 with the main fuel valve relay coil 37. It is apparent that the transistor switch means 62 including the transistor 61 is capable of supplying power to the junction 64, and then to the coil 37 and the transistor 36. It is apparent that both the transistors 61 and 36 must be conducting for the relay coil 37 to be energized to control the main fuel valve 11. This redundant connection of transistors provides an assurance that the main fuel valve relay 37 can be deenergized for safety purposes.

The junction 64 is also connected to a voltage divider means 65 made up of the resistors 66 and 67. The junction between the resistors 66 and 67, at 68, is connected by the conductor 69 to the microcomputer flame safeguard programmer 16. The voltage divider means 65 provides a logic level signal which is capable of providing the microcomputer flame safeguard control system 20 with a signal for use in testing the redundant flame signal detection circuit 45 and its associated transistor switch means 62. While the system described to this point could function as a safety control system, an additional safety function is disclosed.

A flame signal interruption means is generally disclosed at 70 in two forms. The selection of the form is demonstrated by way of a single-pole, double-throw switch 71 capable of connecting to two different types of interruption means. The interruption means on the right provides for the switch 71 to be connected to the conductor 72 which in turn is connected to a transistor 73 that is capable of shorting the flame signal at conductor 26 to ground. The switch 71 is driven from a conductor 74 and the microcomputer flame safeguard programmer 16. The conductor 74 has a pulsed voltage signal. It is apparent that if the switch 71 is in the position shown (connecting to the conductor 72), the pulsed output drives the transistor 73 periodically. This periodic driving of the transistor 73 causes it to short out the flame signal on conductor 26. The frequency at which this occurs is sufficient to test the flame detection circuit for proper operation. The microcomputer controls the test pulse and checks for proper flame amplifier response. The redundant flame signal detection circuit's timing function must prevent the test pulse from turning transistor 60 off when flame is present.

If the switch 71 is connected to terminal 76, a conductor 77 is energized with the pulsing signal to drive a transistor 80. The transistor 80 in turn connects a solenoid 81 between a voltage source 82 and ground 83. The solenoid 81 in turn drives a shutter 84 that is interposed between the flame 14 and the flame sensor 21. The periodic operation of the shutter 84 causes the flame signal through the flame amplification chain of the flame sensor 21, the sensor drive circuit 23, the signal filter 25, and the linear amplifier 26 to be interrupted periodically in response to the voltage signal on conductor 74. This provides the flame sensor and flame detection circuit with a simulation of flame failure in order for the microcomputer to check the flame detection system, but this simulation is sufficiently brief so that the redundant flame detection circuit does not de-energize the main fuel valve 11 unless flame is actually lost at the burner 13. A flame amplifier 85 includes most of the flame detection system and the flame signal interruption means 70.

OPERATION

The operation of the control system will now be briefly described. The burner controller 15 causes the microcomputer flame safeguard programmer 16 to energize the burner and provide flame at the burner means 13. The flame 14 is detected by the flame sensor 21 and the amplified analog signal is provided at the conductor 28. This signal is split between the analog-to-digital converter 32 and the redundant flame signal detection circuit means 45. The analog-to-digital converter 32 provides a digital signal to the microcomputer flame safeguard programmer 16. The microcomputer programmer 16 then supplies a control signal to the transistor 36 turning that transistor "on" so that a conductive path is provided to the main fuel valve relay 37 under normal circumstances.

The normal circumstance would be when the flame signal is present on the conductor 31 where the amplifiers 46 and 47 in turn cause the transistor 60 to conduct which in turn causes the transistor 61 to conduct. With transistor 61 conducting along with the transistor 36, a series circuit is formed that supplies energy to the main fuel valve relay 36. At this same time the voltage at the junction 64 is altered and the voltage divider means 65 provides a feedback signal on conductors 69 indicating to the microcomputer flame safeguard programmer 16 a proper voltage for normal operation of the main fuel valve 11.

In the event of a failure in the microcomputer flame safeguard programmer 16 that allows the transistor 36 to conduct when it should not be conducting, that is when a flame out does occur and no flame is present at burner 13, the signal on the conductor 31 will fall below the level of an acceptable flame signal. The signal is compared with the voltage reference 51 and the transistor 61 is driven "off". This insures a turn off of the power to the main fuel valve relay 37 even if the transistor 36 is unable to properly respond.

The redundant flame signal detection circuit means 45 utilizes the resistor 53 and the capacitor 54 to provide a time constant or timing circuit to insure that the redundant flame signal detection circuit means 45 is secondary in control in response to the flame signal 28 to that of the microcomputer flame safeguard programmer 16. This means that the time constants are selected so that the redundant flame signal detection circuit means 45 does not inadvertently shut down the main fuel valve 11 when the microcomputer programmer 16 is functioning properly. Also, the time constant insures that the redundant circuit ignores the periodic check pulse sent by the microcomputer to the flame amplifier 85.

The timing of the pulses on conductors 74, the time constants of the amplifier chain at flame filter 25, and the balance of the dynamics of the electronics are so selected that the microcomputer flame safeguard programmer 16 always has primary control in preference to the redundant flame signal detection circuit means 45.

From the above description it is apparent that a control system for use in flame safeguard equipment has been provided wherein a redundant control of the main fuel valve is provided. This redundant control insures safe cut off of the main fuel valve when flame is not present, and protects against equipment failure in the microelectronics of the device. The present concept is subject to many modifications and the applicants wish to be limited in the scope of their invention solely by the scope of the appended claims.

The embodiments of the invention in which an exclusive property or right is claimed are defined as follows:

1. A control system for processing a flame responsive output signal to insure cut-off control of main fuel valve means, including: a microcomputer flame safeguard control system adapted to operate a fuel burner including main fuel valve means; said flame safeguard control system including a flame sensor adapted to respond to flame at said fuel burner; flame amplifier means having input means connected to said flame sensor and output means providing an analog signal representative of flame at said fuel burner; analog-to-digital converter means having input means connected to receive said analog signal from said flame amplifier means, and having output means connecting a digital signal to said microcomputer to provide said microcomputer with a digital signal representative of flame at said fuel burner; said microcomputer having output means connected to said fuel valve means to control the energization of said fuel valve means; redundant flame signal detection circuit means having input means connected to said analog signal representative of flame at said fuel burner; said redundant flame signal input means further including a reference voltage; said redundant flame signal detection circuit means including amplifier means comparing said reference voltage and said analog signal; said redundant flame signal detection circuit means having switched output means connected in a series circuit with said microcomputer output means to redundantly control the energization of said fuel valve means; and voltage divider network means having an input connected to said series circuit and an output connected to said microcomputer to supply said microcomputer with a signal representative of the state of operation of said redundant flame signal detection circuit means; said fuel valve means being capable of being deenergized by the operation of said microcomputer output means, or the operation of said redundant flame signal detection circuit means.

2. A control system for processing a flame responsive output signal as claimed in claim 1 including said redundant flame signal detection circuit means having a flame failure signal threshold and a reaction time selected to allow said microcomputer system to exercise primary control over said main fuel valve means.

3. A control system for processing a flame responsive output signal as claimed in claim 2 wherein said switched output means includes first solid state switch means; said microcomputer output means including second solid state switch means; and said solid state switch means being connected in said series circuit.

4. A control system for processing a flame responsive output signal as claimed in claim 2 wherein said control system further includes flame signal interruption means periodically interrupting a signal from said flame; and said microcomputer system having a test pulse output signal connected to said flame signal interruption means to operate said interruption means; said flame signal being interrupted and restored at a rapid rate to avoid the operation of said redundant flame signal detection circuit means; said microcomputer system monitoring said signal from said flame detection system to verify proper operation of said system.

5. A control system for processing a flame responsive output signal as claimed in claim 4 wherein said interruption means is mechanical shutter means periodically interposed between said flame and said flame sensor to simulate the loss of said flame.

6. A control system for processing a flame responsive output signal as claimed in claim 5 wherein said mechanical shutter means includes a shutter operated by electromagnetic coil means connected to said test pulse output signal.

7. A control system for processing a flame responsive output signal as claimed in claim 6 wherein said interruption means is a solid state switch connected to repetitively short out said flame analog signal to simulate the loss of said flame.

8. A control system for processing a flame responsive output signal as claimed in claim 3 wherein said redundant flame signal detection circuit means includes two series connected operational amplifiers with said operational amplifiers separated by a resistor-capacitor timing circuit; each of said operational amplifiers having an input connected to said reference voltage; a second of said two operational amplifiers controlling said first of said series connected solid state switch means; and said first of said solid state switch means including a pair of transistors.

9. A control system for processing a flame responsive output signal as claimed in claim 8 wherein said second solid state switch means controlled by said microcomputer system includes a transistor.

10. A control system for processing a flame responsive output signal as claimed in claim 1 wherein said voltage divider network means further includes:

means for supplying an operational state signal having a logic level, and means in said microcomputer receiving said operational state signal from the voltage divider network means for testing the redundant flame signal detection circuit means.

11. A control system for processing a flame responsive output signal to ensure cut-off control of main fuel valve means, including: a microcomputer flame safeguard control system adapted to operate a fuel burner including main fuel valve means; said flame safeguard control system including a flame sensor adapted to respond to flame at said fuel burner; flame amplifier means having input means connected to said flame sensor and output means providing an analog signal representative of flame at said fuel burner; analog-to-digital converter means having input means connected to receive said analog signal from said flame amplifier means, and having output means connecting a digital signal to said microcomputer to provide said microcomputer with a digital signal representative of flame at said fuel burner; said micrcomputer having output means connected to said fuel valve means to control the energization of said fuel valve means; redundant flame signal detection circuit means having input means connected to said analog signal representative of flame at said fuel burner; said redundant flame signal input means further including a reference voltage; said redundant flame signal detection circuit means including amplifier means comparing said reference voltage and said analog signal; said redundant flame signal detection circuit means having switched output means connected in a series circuit with said microcomputer output means to redundantly control the energization of said fuel valve means; and voltage testing means having an input connected to said series circuit and an output connected to said microcomputer to supply said microcomputer with a signal representative of the state of operation of said redundant flame signal detection circuit means; said fuel valve means being capable of being de-energized by the operation of said microcomputer output means, or the operation of said redundant flame signal detection circuit means.

12. A control system for processing a flame responsive output signal as claimed in claim 11 including said redundant flame signal detection circuit means having a flame failure signal threshold and a reaction time selected to allow said microcomputer system to exercise primary control over said main fuel valve means.

13. A control system for processing a flame responsive output signal as claimed in claim 11 wherein said redundant flame signal detection circuit means includes two series connected operational amplifiers with said operational amplifiers separated by a resistor-capacitor timing circuit; each of said operational amplifiers having an input connected to said reference voltage; a second of said two operational amplifiers controlling said first of said series connected solid state switch means; and said first of said solid state switch means including a pair of transistors.

14. A control system for processing a flame responsive output signal as claimed in claim 11 wherein said control voltage testing means further includes flame means for supplying an operational state signal having a logic level, and means in said microcomputer receiving said operational state signal from the voltage testing means for testing the redundant flame signal detection circuit means.

* * * * *